United States Patent [19]

Hutson

[11] Patent Number: 4,611,717

[45] Date of Patent: Sep. 16, 1986

[54] DISPLAY CASE WITH IMPROVED SHELF AND ROD BRACKETS

[75] Inventor: Frederick O. Hutson, Fort Smith, Ark.

[73] Assignee: Gemtron Corporation, Sweetwater, Tenn.

[21] Appl. No.: 727,018

[22] Filed: Apr. 25, 1985

[51] Int. Cl.[4] ..... A47F 7/08

[52] U.S. Cl. ..... 211/34; 248/250; 248/251; 248/DIG. 12

[58] Field of Search ..... 312/140; 108/109; 403/391, 398, 399, 200, 187; 211/34; 248/235, 251, 239, 250, DIG. 12

[56] References Cited

U.S. PATENT DOCUMENTS

| | | | |
|---|---|---|---|
| 2,471,977 | 5/1949 | Power | 312/140 |
| 3,294,347 | 12/1966 | Mongesku et al. | 248/251 |
| 4,110,951 | 9/1978 | Padrun | 403/399 |
| 4,223,966 | 9/1980 | Winters | 312/187 |
| 4,234,094 | 11/1980 | Jorgensen | 211/106 |
| 4,361,099 | 11/1982 | Kokenge et al. | 248/250 |
| 4,444,321 | 4/1984 | Carlstrom | 248/239 |

FOREIGN PATENT DOCUMENTS

| | | | |
|---|---|---|---|
| 1064123 | 10/1952 | France | 312/140 |

*Primary Examiner*—William E. Lyddane
*Assistant Examiner*—Joseph Falk
*Attorney, Agent, or Firm*—Diller, Ramik & Wight

[57] ABSTRACT

A novel glass display case is disclosed herein and includes a plurality of vertical side walls with openings therethrough, a plurality of brackets associated with the side walls, each bracket including a body of a generally U-shaped configuration defined by a pair of spaced legs and an arm joined therebetween, a slot defined by the pair of legs and arm for supportingly receiving therein an edge of an article-supporting shelf, and the legs defining therebetween recesses disposed normal to each other for receiving ends of rods from which can be suspended or supported for display purposes suitable articles, such as ties or shoes.

5 Claims, 13 Drawing Figures

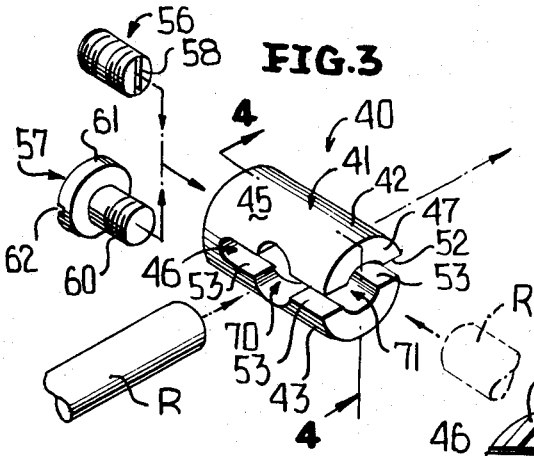
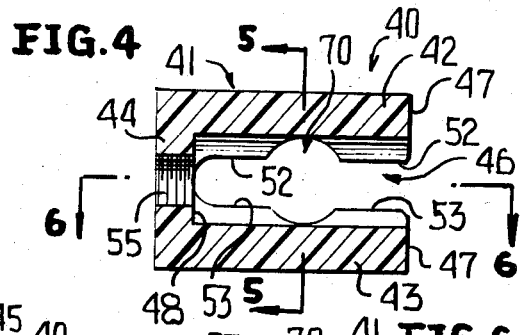
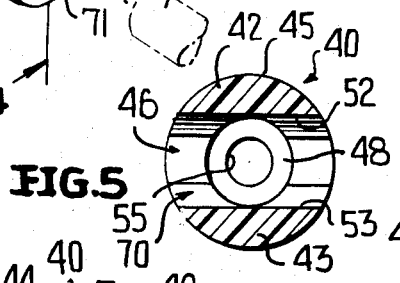
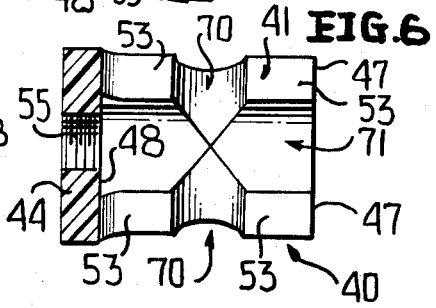
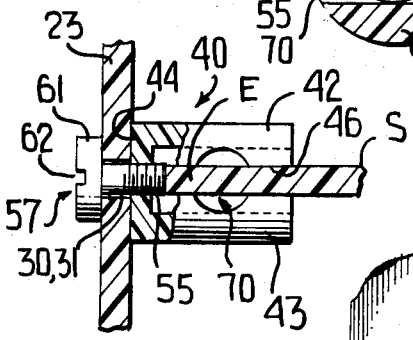
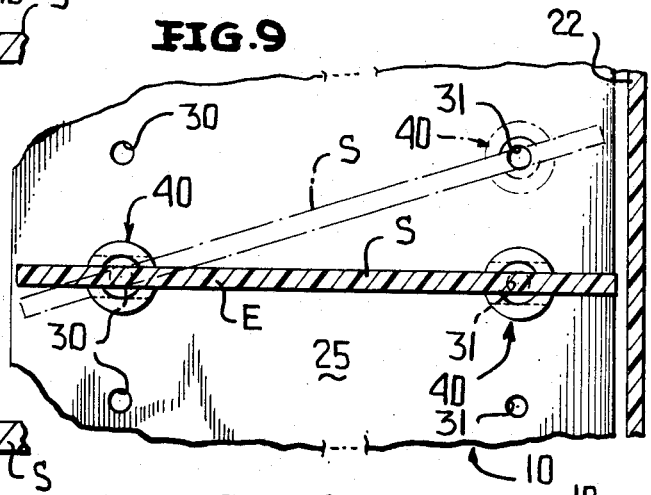
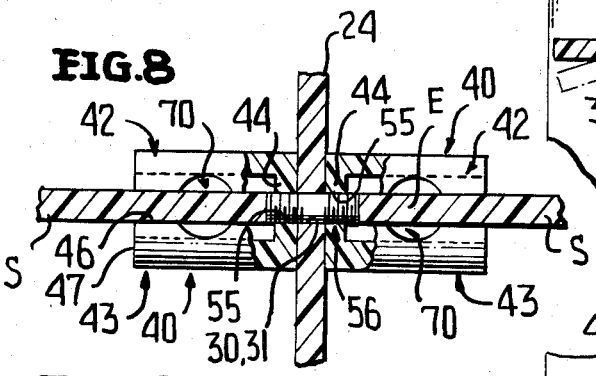
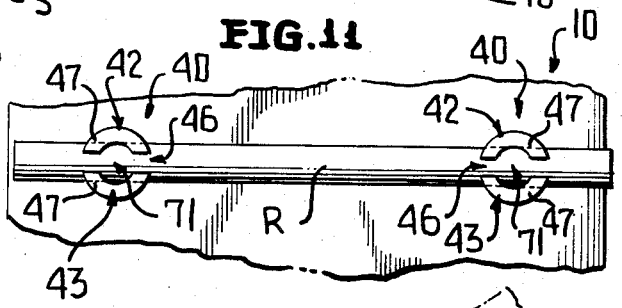
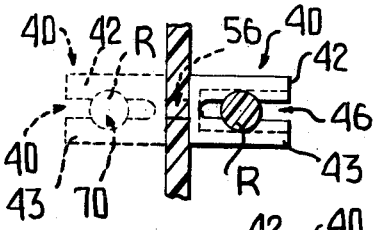
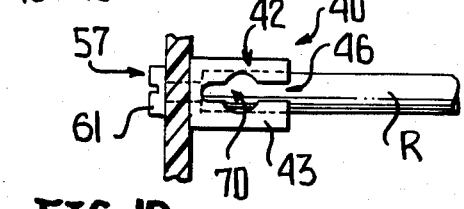
FIG.12
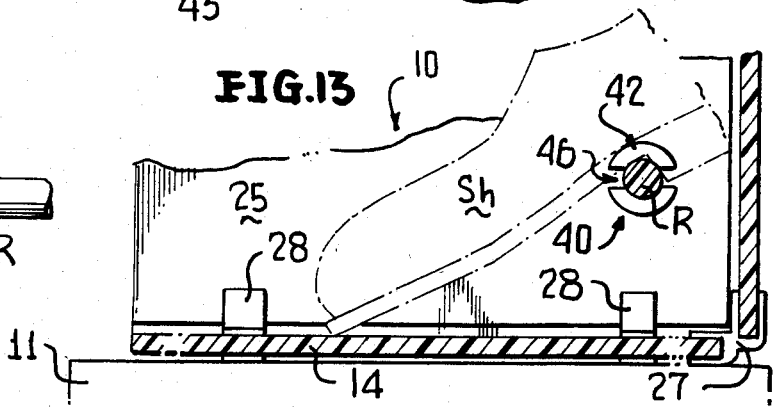

DISPLAY CASE WITH IMPROVED SHELF AND ROD BRACKETS

The present disclosure is directed to a novel display case which is formed of a plurality of transparent glass or plastic panels, selective ones of which have a pluraltiy of openings much in the manner disclosed in U.S. Pat. No. 4,444,321 in the name of William Carlstrom, issued Apr. 24, 1984 and U.S. Pat. No. 4,223,966 in the name of Albert C. Winters, issued on Sept. 23, 1980. The latter patents each disclose shelf brackets associated with the display cases thereof, and the shelf brackets each include a pair of legs spanned by an arm which collectively define a slot for receiving an edge of an associated shelf. Two of such U-shaped bodies or brackets are suitably secured to vertical walls of the display case through the associated openings thereof and the brackets support shelves upon which articles can be displayed. Such brackets are limited due to their structure to supporting only shelves and can not be utilized for supporting elongated elements, such as display rods from which might be suspendingly supported ties, socks, kerchiefs, or heavier articles, such as shoes, slippers or the like.

In keeping with the foregoing, the present invention provides a novel bracket which is particularly adapted to support not only a shelf, but also a rod in conjunction with another identical bracket, each bracket including a body, each body being of a generally U-shaped configuration defined by a pair of spaced legs and an arm joined therebetween, the arm having a threaded bore for receiving a threaded fastener, a slot defined by the pair of legs and arm for supportingly receiving therein an edge of an article-supporting shelf, and at least one of the legs including means for locating and supporting an article-supporting rod.

Still another object of this invention is to provide a novel bracket as aforesaid wherein the rod locating and supporting means is a recess formed in the legs of each U-shaped body transverse to the direction of projection of the legs relative to the arm whereby a rod can span these recesses when the brackets are secured to a vertical wall of an associated display case for suspending or supporting merchandise therefrom.

Still another object of this invention is to provide a novel bracket as aforesaid wherein an additional recess normal to the first-mentioned recess is provided, the brackets are supported from adjacent spaced vertical walls, and a rod spans the distance from the last-mentioned recesses to once again permit article support or suspension for display or merchandising purposes.

With the above and other objects in view that will hereinafter appear, the nature of the invention will be more clearly understood by reference to the following detailed description, the appended claims and the several views illustrated in the accompanying drawings.

IN THE DRAWINGS

FIG. 3 is an exploded perspective view of one of the brackets, and illustrates each of two threaded fasteners associated therewith and the bracket defined by a body formed of a pair of legs and a bridging arm with the legs in turn also defining a slot for a shelf and two recesses disposed generally normal to each other for receiving article-supporting/suspending rods.

FIG. 4 is an enlarged cross-sectional view taken generally along line 4—4 of FIG. 3, and illustrates the slot and recesses of the U-shaped body in detail, and a threaded bore in the arm of the body for receiving either of the two fasteners of FIG. 3.

FIG. 5 is a cross-sectional view taken generally along line 5—5 of FIG. 4, and illustrates with more particularly the relationship of the two recesses and slot of the U-shaped bracket.

FIG. 6 is a cross-sectional view taken generally along line 6—6 of FIG. 4, and illustrates the normal relationship of the two recesses.

FIG. 7 is a fragmentary vertical sectional view taken through a side wall and shelf of FIG. 1, and illustrates the manner in which an edge of a shelf is received in the slot between the legs of the bracket and the fastener securing the bracket to the vertical wall.

FIG. 8 is a fragmentary vertical sectional view similar to FIG. 7, but illustrates the manner in which a single fastener threaded along its length is used to support two brackets on opposite sides of a vertical wall through an associated opening thereof.

FIG. 9 is a fragmentary side elevational view of one of the display case vertical walls, and illustrates two of the brackets secured to horizontally aligned openings and a shelf associated therewith in solid outline, while in phantom outline one of the brackets is so positioned as to support the shelf at an incline to the horizontal.

FIG. 10 is a fragmentary sectional view of one of the display case vertical side walls, and illustrates a rod received in and supported by one of the recesses between the legs of the U-shaped body.

FIG. 11 is a fragmentary side elevational view of the vertical wall of FIG. 10, and illustrates two of the brackets secured to the vertical wall and a rod supported by aligned recesses thereof.

FIG. 12 is a fragmentary vertical sectional view through a vertical wall, but illustrates a rod in another of the recesses.

FIG. 13 is a fragmentary side elevational view of the wall of FIG. 12, and illustrates the manner in which the rod is received in the recess of the associated bracket, and in phantom outline a shoe supported thereupon.

Figure 1:
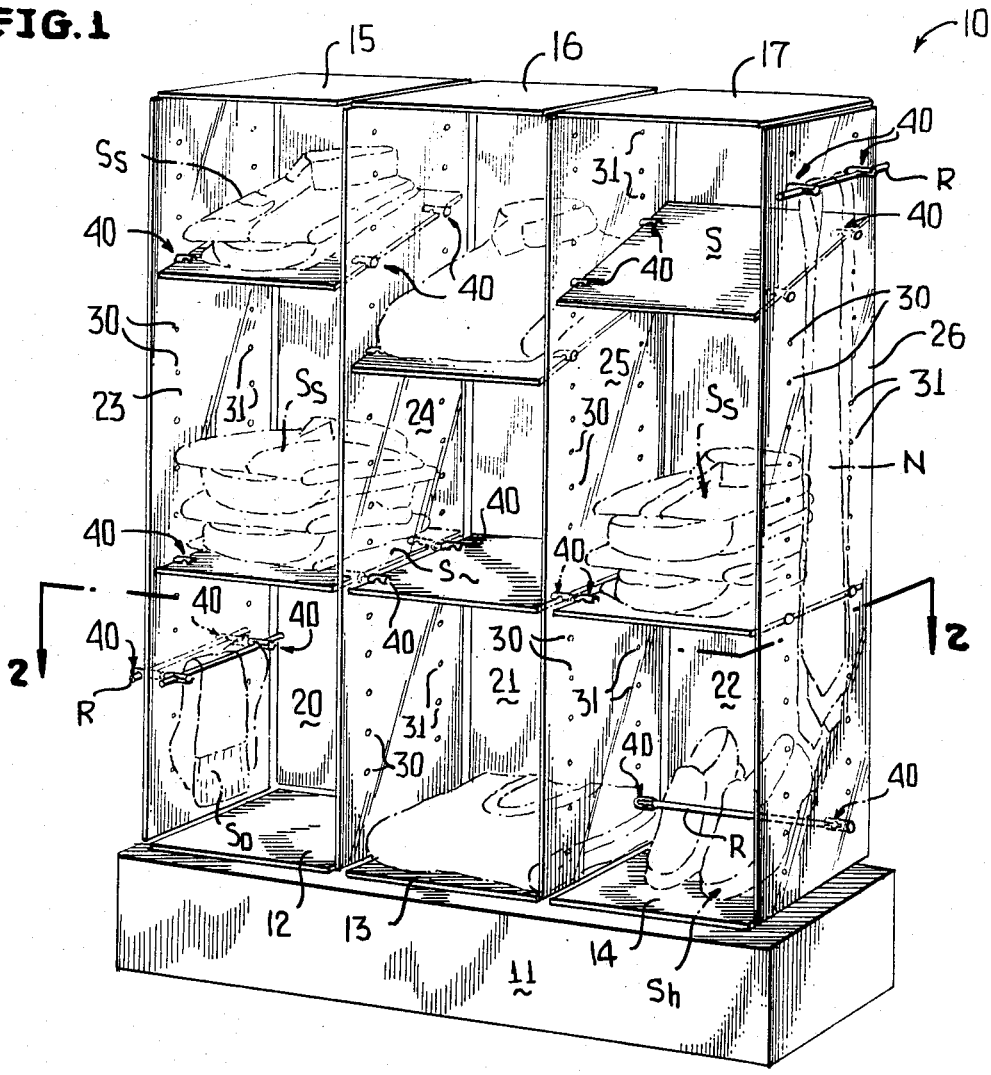
FIG. 1 is a front perspective view of a display case constructed in accordance with this invention, and illustrates a plurality of novel brackets selectively supporting shelves or rods and display merchandise associated therewith.
Figure 2:
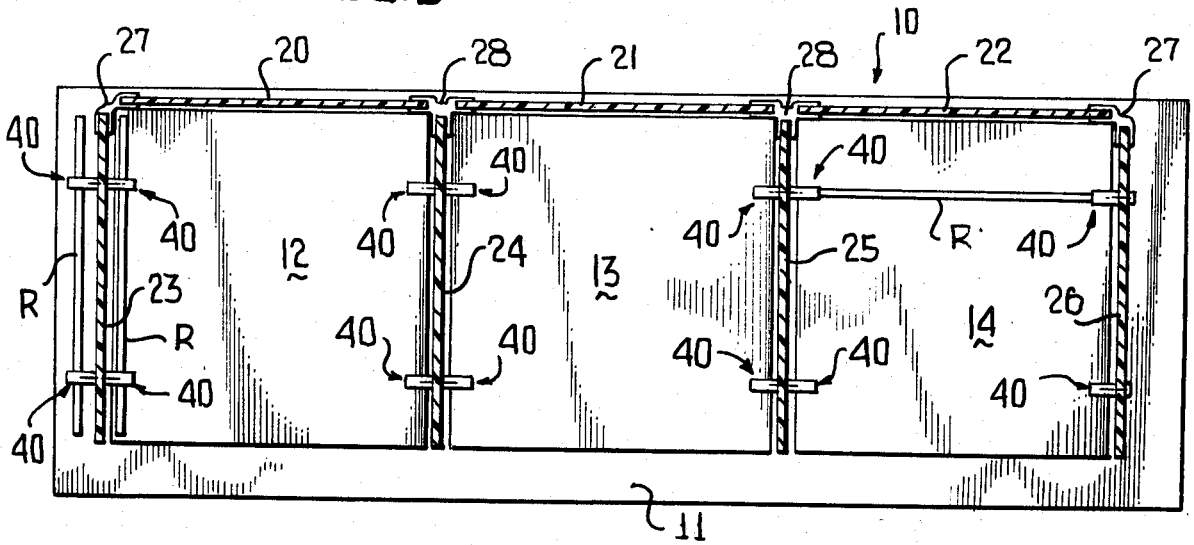
FIG. 2 is a fragmentary sectional view taken generally along line 2—2 of FIG. 1, and illustrates the manner in which the brackets support the shelves and the rods.

A display case is illustrated in FIG. 1 of the drawings and is generally designated by the reference numeral 10. The display case 10 is formed by a base 11 upon which rests a series of glass bottom plates 12, 13 and 14 and at the top of which are similar glass top plates 15, 16 and 17. The plates 12, 15; 13, 16; and 14, 17 are spanned by vertical back plates 20, 21 and 22, respectively. Vertical side plates 23 through 26 form the final walls of the overall display case 10. The various walls or panels 12 through 17 and 20 through 26 are connected to each other by conventional L-shaped clips 27 and T-shaped clips 28. For example, the L-shaped clips 27 secure the walls or panels 15, 23; 12, 23; 20, 23; 22, 26; 14, 26; etc. to each other, whereas the T-shaped clips secure the walls or panels 15, 16, 24; 16, 17, 25; 12, 13, 24; 20, 21, 24; etc. to each other. In this fashion the L-shaped clips 27 and the T-shaped clips 28 rigidly unite the panels or walls 12 through 17 and 20 through 26 to each other.

while at the same time permitting the overall display case 10 to be readily disassembled or knocked-down.

The vertical side walls or panels 23 through 26 are provided with pairs of horizontally aligned, vertically spaced openings 30, 31, and if desired, the same openings can be formed in the top walls or panels 15 through 17 and back or rear walls or panels 20 through 22. The openings 30, 31 function to support from selected pairs of the vertical walls 23 through 26 relatively flat rectangular glass shelves S or associated rods R (FIG. 1). The shelves S can support such articles as shirts SS, sweaters or the like for display or merchandising purchases, while the rods R might similarly support/suspend neckties N, belts (not shown), socks So, shoes Sh, or the like.

The major innovation of the present invention is that of a bracket 40 (FIGS. 3 through 6) associated with the various walls of the display case 10 for supporting any one of the shelves S or rods R illustrated in FIG. 1.

The novel bracket 40 (FIGS. 3 through 6) of the present invention is preferably constructed from a single piece of plastic material and includes a body 41 which is in turn defined by a pair of legs 42, 43 (FIG. 4) and an arm or bight 44 therebetween. The overall body 41 is of a generally cylindrical outer configuration defined by an outer cylindrical surface 45 interrupted by an elongated axial slot or slot means 46 defined between the legs 42, 43 and extending generally the entire axial length of the latter from end faces 47 thereof toward and terminating at an inner end face 48 of the arm 44. The slot or slot means 46 is essentially set-off between faces 52, 52 of the upper leg 42 (FIGS. 3 and 4) opposing faces 53, 53 of the lower leg 43 (FIGS. 3 and 4). The distance between the faces or edges 52, 53 corresponds to the thickness of any one of the shelves S and, thus, each slot 46 can snuggly receive an edge E (FIG. 7) of a shelf S therein.

Means generally designated by the reference numeral 55 (FIG. 4) in the form of a threaded bore is provided in the bight or arm 44. The threaded bore 55 is of a size corresponding generally to the openings 30, 31 and is adapted to be aligned therewith. Depending upon the particlar utilization of the brackets 40, either of fasteners or fastening means 56, 57 (FIG. 3) can be utilized by passing through the selected openings 30, 31 and being threaded in the threaded bore 55. The fastening means 56 is threaded along its entire length, does not include a head, but may include a diametric slot 58 at each of its axial opposite ends for receipt of a screwdriver blade. Fastening means 57 includes a threaded stem 60, an enlarged head 61, and a slot 62 and the latter similarly can receive a screwdriver blade.

Reference is made to FIG. 7 which illustrates the manner in which the bracket 40 shown therein is attached to the opening 30 of the wall 23 by the fastening means or fastener 57. In this case the head 61 bears against the outer surface (unnumbered) of the vertical wall 23, the stem 60 passes through the opening 30, and the stem 60 is threaded in the threaded bore 55 of the bracket 40. Four such brackets are so secured to support a single shelf S, as is clearly illustrated by the uppermost shelf S of the display case 10 immediately beneath the top panel 17 of FIG. 1. The relationship of the shelf S latter described and the associated brackets 40 is also represented in FIG. 9 in phantom outline, and it is to be understood that this same figure reflects the manner in which the brackets 40 can be positioned totally in a horizontal plane, such that the shelf S (FIG. 9) is likewise supported in a horizontal plane, rather than being inclined thereto (phantom ouline in FIG. 9). Accordingly, the brackets 40 thus far described can be utilized in conjunction with the fasteners 57 to support appropriate ones of the shelves S, but if shelves are to be supported in horizontal alignment on opposite sides of the same vertical wall, the threaded fastener 56 is utilized in the manner shown best in FIG. 8. In this case (FIG. 8), the threaded fastener 56 is passed through another of the openings 30, 31 of the vertical wall 24 and is threaded in the threaded bores 55 of brackets 40, 40 on opposite sides of the vertical wall, such as the wall 24 of FIG. 1 and the two lowermost aligned shelves S associated therewith. In this fashion, the two lowermost brackets projecting from the right of the vertical wall 24 in FIG. 1 support one shelf along its edge, whereas the two brackets projecting to the left of the same vertical wall 24 in FIG. 1 support another edge of the shelf S to the left of the vertical wall 24. Therefore, in those cases where the shelves SS are to be horizontally aligned the fasteners 56 are utilized whereas in cases where the shelves on opposite sides of a vertical panel or wall are to be offset or lie in other than a common plane, the fasteners 57 can be utilized. In either case, the brackets 40 can be readily secured to or removed from the fasteners 56, 57 by simply relatively threading and/or unthreading the same.

The bracket 40 (FIGS. 3 through 6) also includes means 70 in the form of a recess or bore of a generally circular configuration defined by arcuate portions (unnumbered) of the edges 52, 53 of the respective legs 42, 43 for locating and supporting ends of the rods R, as is best exemplified by the rod R of FIGS. 10, 11 and the rods R secured to the vertical walls 23 and 26 of FIG. 1. The rods R are of a diameter corresponding to the bore or recess 70 and are snuggly received therein from which the neckties N and/or the socks So can be suspendingly supported. It should be particularly noted that in the case of the rods R associated with the recesses or bores 70, a plane through the axis of the rods R is normal to the axis of the treaded bores 55 of the associated arms 44 and in spaced parallel relationship to a plane of thhe associated vertical walls 23, 26, for example.

The bracket 40 is also provided with a bore or recess means 71 (FIGS. 3 through 6) which is defined between the legs 42, 43 by generally semi-cylindrical surfaces (unnumbered) of each which run the length of the legs 42, 43 between the end faces or edges 47 thereof and the inner face 48 (FIG. 4) of the arm 44. The bore, recess, or recess means 71 is of a size to similarly snuggly receive an end of any one of the rods R and the axis of the bore 17 is coincident to the axis of the threaded bore 55 (FIGS. 4 through 6). The recesses 71 permit two of the brackets 40 to be mounted in axially aligned relationship from opposite ones of the walls, such as the rod R illustrated spanning the walls 25, 26 of FIG. 1. In this case the rod R is positioned with its ends inserted in the recesses 71 of the aligned brackets 40 adjacent the bottom plate 14 (FIG. 13) such that shoes Sh can be in part supported therefrom in the manner depicted in FIG. 13 of the drawings. Thus, FIGS. 10 and 11 illustrate the manner in which a pair of brackets 40 can be utilized to suspend or support articles for a single wall, whereas FIGS. 12 and 13 illustrate the manner in which two brackets 40 can be used to suspend or support articles from two different spaced vertical walls.

Accordingly, in keeping with the present invention the novel bracket 40 can be utilized such that its slot or slot means 46 can support a shelf S, or its recess means 70 can support a rod R from a single wall or the recess means 71 of axially aligned brackets 40 can support a rod R from opposite vertical walls.

Although in a preferred embodiment of the invention as has been specifically illustrated and described herein, it is to be understood that minor variations may be made in the apparatus without departing from the spirit and scope of the invention, as defined in the appended claims.

What is claimed is:

1. A display stand comprising at least two spaced generally parallel vertical walls each having a plurality of openings therein, a pair of brackets adjacent a pair of openings of each vertical wall, each bracket including an elongated body of a generally U-shaped configuration defined by a pair of spaced legs and an arm joined therebetween, and article-supporting shelf having opposite lateral edges, slot means defined by each of said pair of legs and arm for supportingly receiving therein said lateral edges thereby supporting said shelf in spanning relationship between said vertical walls, a threaded bore in and normal to each said arm, a threaded fastener spanning an associated opening and being threaded in an associated threaded bore for retaining said brackets upon said vertical walls, a second bore in each body, and the second bores of the pair of brackets on each wall being aligned whereby a rod can be positioned with opposte ends disposed one each in the second bores of the pair of brackets on each vertical wall for supporting articles by the rod of each vertical wall.

2. The display stand as defined in claim 1 including another bore in each bracket normal to each second bore, and the diameters of said another bores and second bores being generally the same whereby a rod of like diameter can be disposed therein.

3. The display stand as defined in claim 2 including a rod having a diameter corresponding to the diameters of said another and second bores.

4. The display stand comprising at least two spaced generally parallel vertical walls each having a plurality of openings therein, a bracket adjacent an opening of each vertical wall, each bracket including an elongated body of a generally U-shaped configuration defined by a pair of spaced legs and an arm joined therebetween, slot means defined by each of said pair of legs and arm for supportingly receiving therein lateral edges of an article-supporting shelf in spanning relationship between said vertical walls, a treaded bore in and normal to each said arm, a threaded fastener spanning an associated opening and being threaded in an associated threaded bore for retaining said brackets upon said vertical walls, a second bore in each body coaxial with each associated threaded bore, the second bores of the brackets being aligned, and a rod spanning said walls and positioned with opposite ends thereof disposed one each in the second bores of the brackets whereby articles can be supported by said rod.

5. The display stand as defined in claim 4 including another bore in each bracket having a diameter generally corresponding to the diameter of each second bore and said rod.

* * * * *